US005127491A

United States Patent [19]

Just-Buddy

[11] Patent Number: 5,127,491

[45] Date of Patent: Jul. 7, 1992

[54] TERRA FIRMA EXTERIOR-MOUNT FIRE/RESCUE ELEVATOR

[76] Inventor: Hayaldree P. Just-Buddy, 301 Webster St., N. W., Washington, D.C. 20011

[21] Appl. No.: 650,634

[22] Filed: Feb. 5, 1991

[51] Int. Cl.[5] ..... A62B 1/02

[52] U.S. Cl. ..... 182/142; 182/19; 187/6

[58] Field of Search ..... 182/142, 143, 36, 37, 182/19; 187/6

[56] References Cited

U.S. PATENT DOCUMENTS

| | | | |
|---|---|---|---|
| 665,707 | 1/1901 | Tromanhauser | 182/142 |
| 1,027,724 | 5/1912 | Haney | 182/142 |
| 4,018,306 | 4/1977 | Lyons | 182/142 |
| 4,355,699 | 10/1982 | Smith | 182/142 |
| 4,406,351 | 9/1983 | Littlejohn | 182/142 |
| 4,473,160 | 9/1984 | Neuenschwander | 182/37 |

*Primary Examiner*—Reinaldo P. Machado
*Attorney, Agent, or Firm*—Cushman, Darby & Cushman

[57] ABSTRACT

A fire/rescue system which overcomes the deficiencies of internal and external fire escapes noted above by providing a plurality of compartments which are mounted to traverse the vertical side walls of a high-rise building to carry individuals from designated locations, vertically distributed along the side walls of the building, to safety of the base of the building. The compartments are stored prior to use and between uses on the roof of the high-rise building, preferably within a specially-designed garage therefor, thus overcoming the aesthetic deficiencies of external fire escapes. In the event a fire and/or smoke sensing device is activated within the building, one or more of the compartments is ejected from the rooftop storage facility and tranverses down the exterior wall(s) of the building. The control system for each compartment is programmed so that the compartment stops briefly at each of certain designated floors to pick up passengers and gradually descends all the way to the ground floor to allow its occupants to exit therefrom. The compartment is then quickly returned to a predesignated point along the side wall of the building, for example adjacent the roof, to repeat the descending/passenger pick-up process. The compartments may also be controlled so as to carry one or more firemen from the ground to various floors of the building to facilitate fire-fighting from the exterior.

10 Claims, 3 Drawing Sheets

TERRA FIRMA EXTERIOR-MOUNT FIRE/RESCUE ELEVATOR

BACKGROUND OF THE INVENTION

1. Field of the Invention

The present invention relates to fire escapes and, more particularly, to an external fire escape which allows individuals to escape from any exposed side wall of a high-rise building into compartments which descend along the same.

2. Description of the Related Art

The advent of high-rise apartment and office buildings has been accompanied by the need for providing a means by which people living or working in such high-rise buildings can escape or be rescued in the event of fire. Indeed, casualties, either by fire, smoke inhalation and/or unsuccessful jumps to safety ar of growing concern and there is a continuing need for providing more advanced and more practical means for escape and/or rescue.

Traditional external fire escapes which are often provided on buildings having a relatively few stories have the disadvantage that individuals retreating from the fire and smoke must walk or run up or down the stairs of the fire escape. Such an escape system is impractical for handicapped individuals and the elderly as well as individuals who have been injured during the course of the fire. Furthermore, such external fire escapes are typically not provided on high-rise buildings because they are generally not aesthetically pleasing.

Thus, for high-rise buildings sprinklers systems together with fire and smoke detectors and internal fire escapes in the form of isolated stairwells have been relied upon to contain fires, to alert the occupants of the presence of a fire, and to allow escape therefrom in the early stages of the fire, respectively. While early warning of the presence of a fire and/or smoke certainly decreases the likelihood that individuals will become victims of the fire, the provision of internal stairwells for escape has a problem common to external fire escapes, that is that the injured, handicapped and elderly will have difficulty traversing the same. Furthermore, access to such stairwells may be blocked by the fire and only limited access to the building interior is provided thereby for rescue workers.

SUMMARY OF THE INVENTION

It would therefore be desirable to provide a fire/rescue system which has the advantages of early warning attendant to smoke and fire detectors but which provides greater access than is available with one or two isolated interior stairwells, overcomes the aesthetic problems attendant to external fire escapes and does not require that the handicapped or otherwise infirm traverse stairways.

The present invention provides a fire/rescue system which overcomes the deficiencies of internal and external fire escapes noted above by providing a plurality of compartments which are mounted to traverse the vertical side walls of a high-rise building to carry individuals from designated locations, vertically distributed along the side walls of the building, to safety of the base of the building. The compartments provided in accordance with the present invention are stored prior to use and between uses on the roof of the high-rise building, preferably within a specially-designed garage therefor, thus overcoming the aesthetic deficiencies of external fire escapes. In the event a fire and/or smoke sensing device is activated within the building, one or more of the compartments provided in accordance with the present invention is ejected from the rooftop storage facility and traverses down the exterior wall(s) of the building. The control system for each compartment is programmed so that the compartment stops briefly at each of certain designated floors to pick up passengers and gradually descends all the way to the ground floor to allow its occupants to exit therefrom. The compartment is then quickly returned to a predesignated point along the side wall of the building, for example adjacent the roof, to repeat the descending/passenger pick-up process. The compartments provided in accordance with the present invention may also be controlled so as to carry one or more firemen from the ground to various floors of the building to facilitate fire-fighting from the exterior.

Other objects, features and characteristics of the present invention, as well as the methods of operation and functions of the related elements of the structure, and the combination of parts and economies of manufacture, will become more apparent upon consideration of the following detailed description and the appended claims with reference to the accompanying drawings all of which form a part of this specification, wherein like reference numerals designate corresponding parts in the various figures.

DETAILED DESCRIPTION OF THE PRESENTLY PREFERRED EXEMPLARY EMBODIMENT

Figure 1:
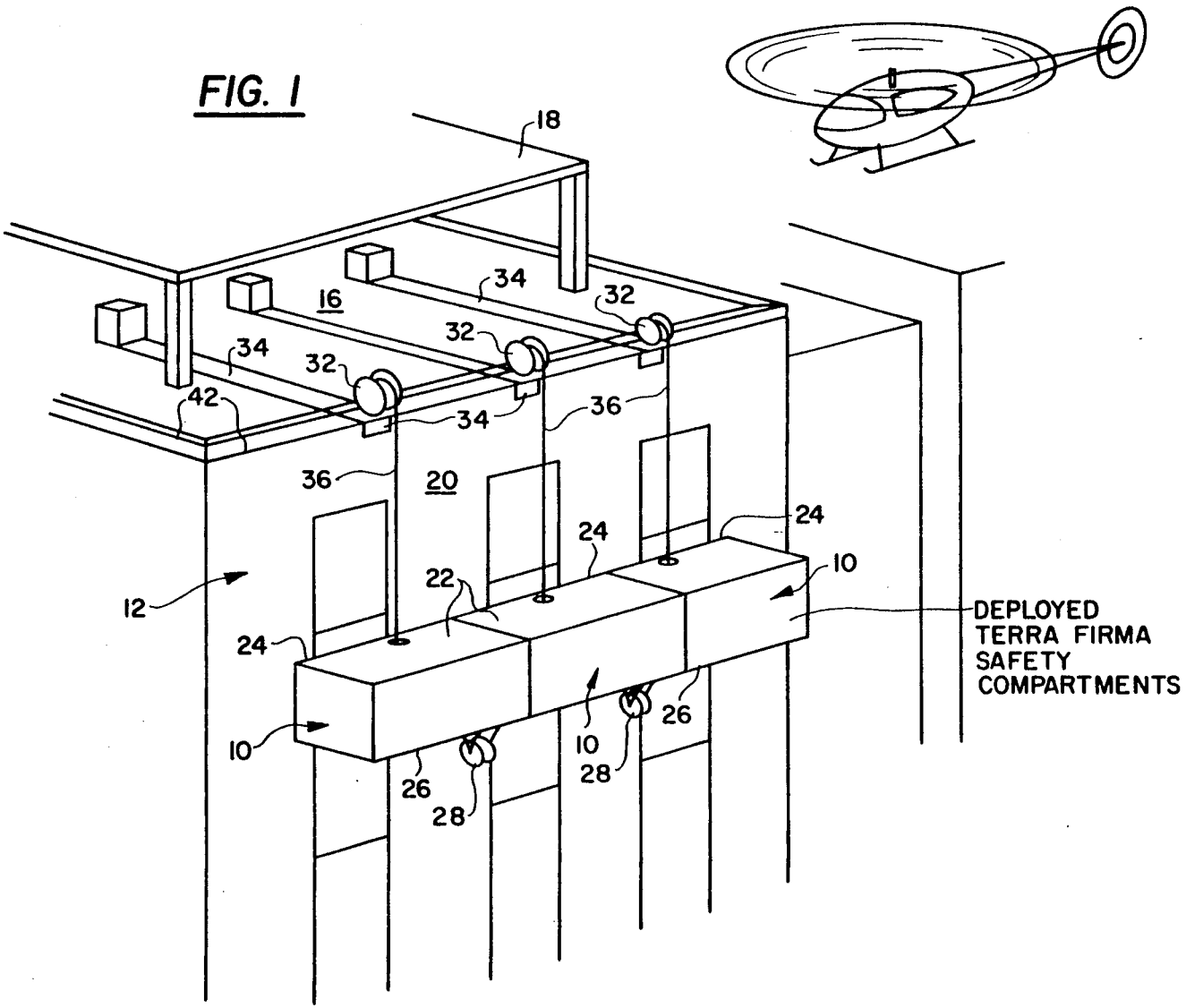
FIG. 1 is a perspective view of a fire/rescue system provided in accordance with the present invention in its deployed configuration.
Figure 2:
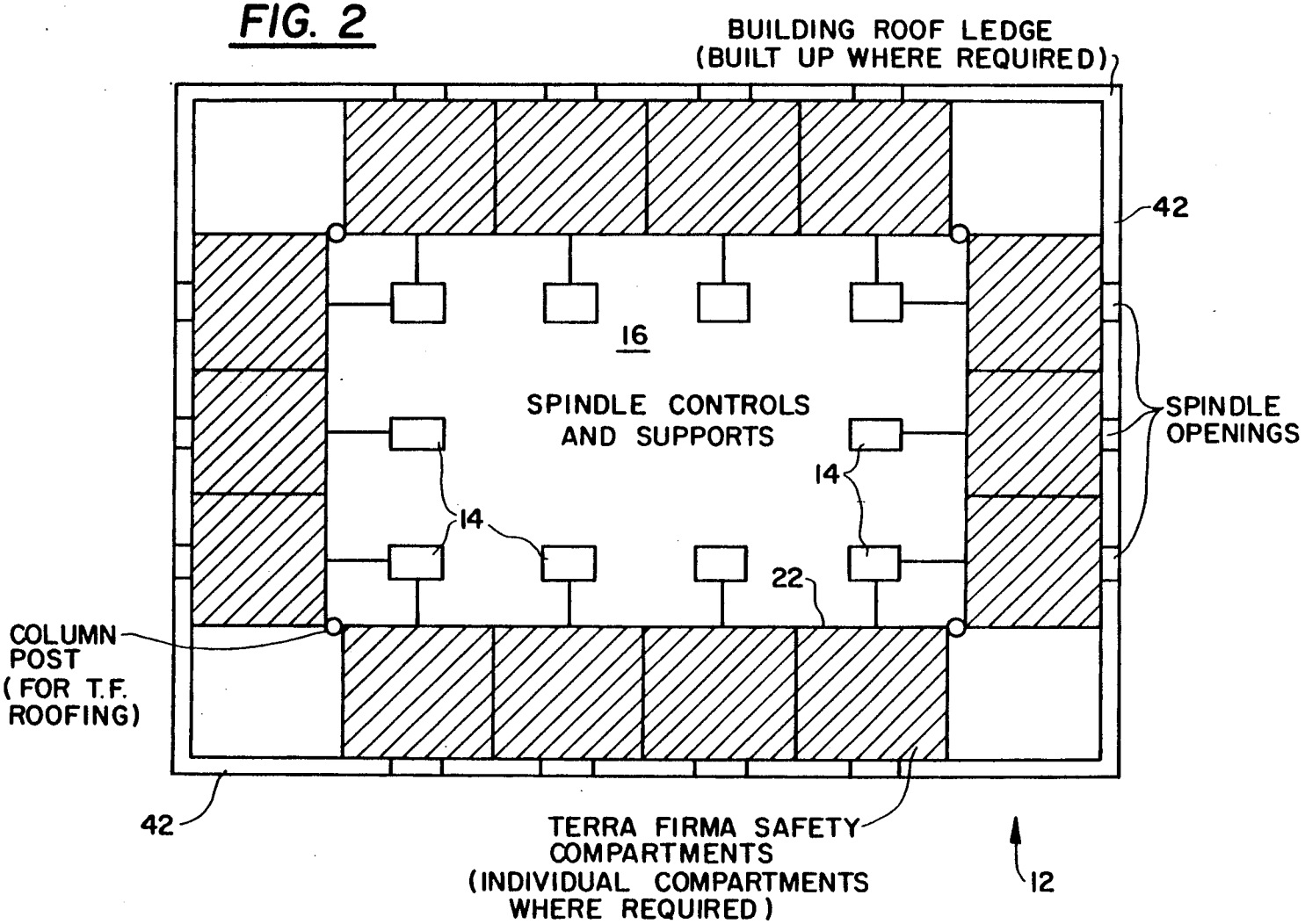
FIG. 2 is a top plan view showing the fire/rescue compartments provided in accordance with the present invention in one possible storage disposition atop a high-rise building.

Referring to FIGS. 1 and 2 in particular, in accordance with the present invention, one or more Terra Firma safety compartments 10 are provided and disposed at predetermined locations about the periphery of a building 12. As shown generally in FIG. 2, a mechanical and electrical control system 14 for each of the Terra Firma compartments 10 is preferably provided on the top floor/roof 16 of the high-rise building 12. Further, as shown in FIG. 1, a protective cover 18 can be mounted to the roof top to protect the controls 14 as well as the compartments 10 themselves from inclement weather.

The protective cover 18 may be in the form of a garage or garages with doors to further protect the compartments 10 from inclement weather or vandalism. When garages are so provided, the control system, discussed more fully below, controls operation of the garage doors upon compartment deployment.

Storing the compartments on the roof 16 has the obvious advantage of confining the same from view and thus does not detract from the aesthetic appearance of the building itself. In addition, the walls of the compartments 10 can be formed from a transparent material so that in their out-of-use position on the roof 16, as shown in FIG. 2, they can serve as a roof top overlook.

More particularly, when the Terra Firma compartments are disposed on the roof 16 in their storage position, as shown schematically in FIG. 2, the top or roof 22 of the Terra Firma compartment 10 is disposed substantially parallel to the exterior side wall 20 of the building and substantially perpendicular to the roof 16 of the building. The top 22 of the compartment 10 is preferably hingedly coupled to the side 24 of the compartment which faces the exterior side wall 20 of the building when the compartment 10 is deployed and defines the floor of the compartment when it is stored on the roof 16. Thus, the top 22 of the Terra Firma compartment can be decoupled from the remainder of the compartment 10 and pivoted about its hinged connection to the side wall 24 of the compartment 10 to define a ramp for facilitating access to the interior of the compartment 10 when in its stored position on the rooftop. By forming at least the bottom 26 of the compartment 10, which is parallel to the exterior side wall 20 of the building 12 when the compartment 10 is in its stored disposition, partially or wholly from a transparent material, the compartment will define a scenic overlook that individuals can enter via the ramp/top 22.

When the Terra Firma compartment(s) are to be deployed, then, the ramp/top 22 of the compartment can be pivoted to its closed disposition and affixed to the remainder of the compartment 10. Such closure of the ramp/top as well as opening thereof is preferably automatic by means of spindles and cables suitable mounted to the compartment, a hydraulically actuated system, or the like. The compartment is then ready for deployment as discussed more fully below.

Each of the compartments 10 provided in accordance with the present invention has large, soft, round tires 28 as well as shock absorbers (not shown) for tilt and balance and to maintain the same in close proximity to the wall of a building 12 as it ascends and descends. The tires are preferably inflatable so that in the rest or non-use disposition on the roof 16 of the building 12, the tires 28 can be deflated. If such deflatable tires 28 are provided, then the tires are automatically inflated during the first stage of deployment, as discussed below.

The control system of the Terra Firma compartments is operatively connected, for example electrically and/or mechanically interconnected, to the smoke and/or fire detectors as well as to the sprinkler system provided within the high-rise building 12. The system can be controlled so as to be activated upon a signal of a single detector or once a plurality of detectors have been activated. Furthermore, the system may be programmed so that the compartments which are deployed correspond to the regions of the building where individuals will most likely be located to avoid such smoke or fire as detected by the smoke/fire detectors. Upon sounding of a predetermined number of such alarms, which would indicate that the fire is not contained in a small area and/or that an area is completely filled with smoke, the gate(s) or door(s) of the top floor garage(s) (not shown in particular) are automatically opened and the Terra Firma compartment or compartments 10 are ejected out of the garage to the side edges of the building 12 and down the exposed side walls 20 of the high-rise.

The compartments 10 of the invention are deployed from their rooftop rest position by a push rod system. Thus, when the Terra Firma compartments are in their stored disposition on the roof, the push rods are located adjacent and inwardly of the compartments. During activation of the system, the push rods extend forwardly toward each the Terra Firma compartments 10 and can suitably engage or activate air canisters provided for inflating the tires of the compartment. Movement of the push rods towards the edge of the roof is continued until approximately 60 percent of the Terra Firma compartment extends over the side edge of the building. At that time, the weight of the compartment 10 tends to pivot the compartment over the side edge of the building 12. Then the weight of the compartment 10 is solely supported by the attached deployment cables 36. The deployment cables 36 are wound about spindles 32 suitably disposed on the roof 16 of the building in question. Descent of each of the compartments, then, is controlled by controlling the rate at which the spindle 32 winds or unwinds the deployment cable(s). As is apparent, the tires 28 of each of the Terra Firma compartments which engage the top floor or roof of the building when the Terra Firma compartments are in their stored disposition are in facing relation to the exterior wall of the compartment during deployment and thus facilitate a smooth descent of the compartment on the side wall of the building.

Figure 3:
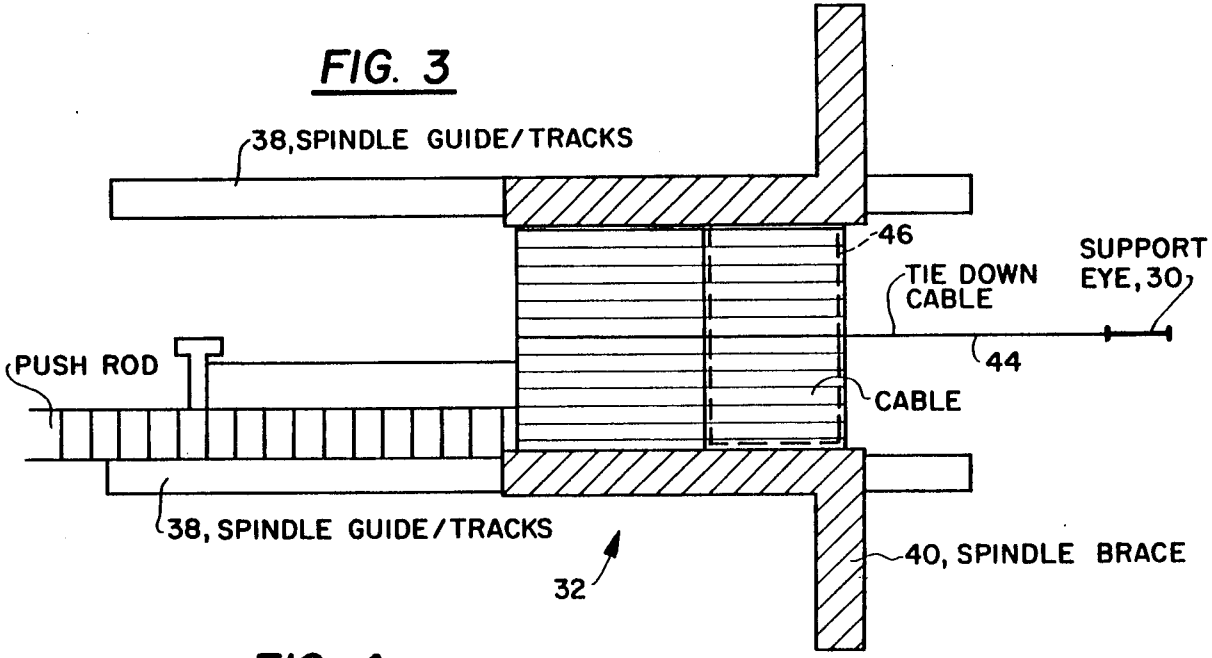
FIG. 3 is a top plan view of a spindle mounted cable for allowing descent of a fire/rescue compartment in accordance with the invention.
Figure 4:
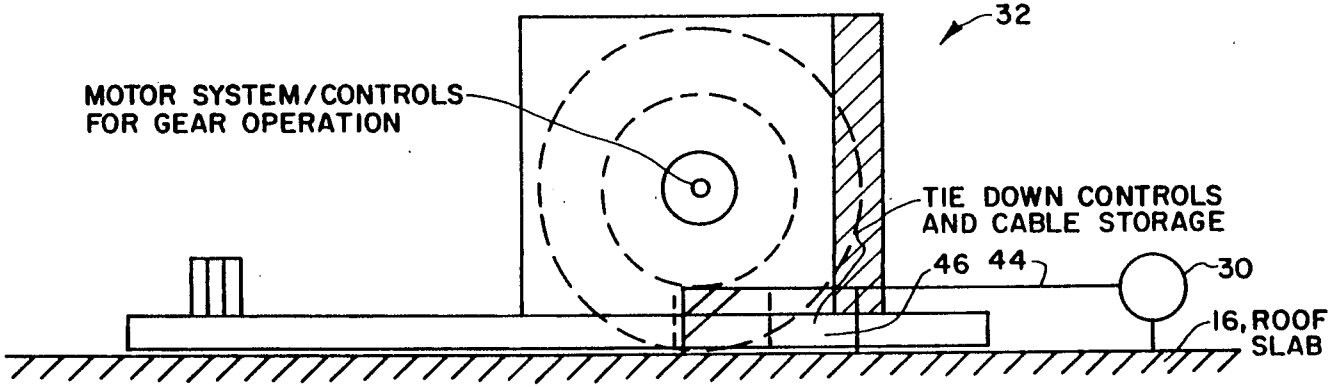
FIG. 4 is a side elevational view of the spindle of FIG. 3.

The spindles 32 are preferably mounted on spindle guide tracks 38 as shown schematically in FIGS. 3 and 4 which are disposed in guide grooves 34 as shown, for example, in FIG. 1 so that when the Terra Firma compartments 10 are urged by the push rods to their deployed disposition, the spindles are similarly urged to the side edge of the building, for example with push rods, to facilitate unimpeded deployment of the deployment cables 36.

An eye support 30 (FIG. 3) is used to provide additional support to the spindles during the compartment deployment, operation, and return. The location of support eye 30 is not illustrated in particular in either of FIGS. 1 or 2 because its location is dependent upon the location of existing columns. If the existing columns were shown, the support eye would be located between the columns of an elevator shaft or behind a built up column.

As shown in FIG. 3, spindle braces 40 are provided and are attached to the sides of the spindle. The spindle brace together with the support eye are used to prevent the spindle from free fall off the side of the building. The spindle brace 40 is designed for the sole purpose of supporting the spindle while in operation and are fitted against the edge of the roof once deployed. Thus, once the spindle has been deployed, the spindle brace will engage for example the building roof ledge 42 (see FIGS. 1 and 2).

Following completion of the task for which purposes the Terra Firma Compartments were deployed, the spindle is pulled back to its storage position by means of a tie down cable 44 which is connected to the spindle and to the eye support 30. A crank (not shown in particular) is connected to the spindle and can be manually operated or powered by a motor to pull the spindle to the storage position. As shown in FIGS. 3 and 4, means 46 are provided for housing the tie down controls and for tie down cable storage.

In accordance with the construction of the particular building, the control system is pre-programmed so that the compartment briefly stops at selected floors or windows or fire safety areas as designated for each high-rise building and ultimately conducts all people aboard the compartment to ground level where they may exit the device. The emptied compartment is then returned to a predetermined location along the side wall of the building. In the alternative, once the initial pass has been made down the side of the building, the fire department can determine whether or not to override the pre-programmed control of the Terra Firma so that the same can be used to carry firemen up the building or otherwise alter the pre-programmed sequence of travel.

In the event that the high-rise in question has balconies, the Terra Firma compartments are provided to descend between adjacent balconies in columns down the side face of the building. On other less ornate or tortuously defined buildings, the Terra Firma compartments can descend immediately adjacent one another down the side face of a building.

The control system for the fire/rescue compartments of the invention is provided on the top floor of a roof, as noted above, and includes tough steel cables 36 wound about spindles 32 which are mounted to the top floor or roof 16 of the building and gradually unwind so that the compartment 10 attached thereto will gradually descend down the side wall 20 of the building, such unwinding being periodically interrupted so as to allow individuals to board the compartment(s) 10. One or more spindler 32 is provided for each compartment. The cable 36 should, of course, be of sufficient length to allow descent of the respective Terra Firma compartment from the rest position atop or adjacent the roof of the building to the ground level.

Power for each of the compartments is provided with an individual electric line which runs from a main power source. In the alternative or additionally, solar powered batteries may be provided in the event that electricity from the main power source is terminated.

As a further alternative, means can be provided for manually causing the ascent or descent of the compartment, such as by using a fire hose crank device conventionally provided on fire trucks. More particularly, a cable system can be stored within the insulated, sandwich structured side wall 24 of the compartment which is facing relation to the outside wall 20 of the building when the compartment is deployed and defines the floor of the compartment when disposed on the roof top. One end of the cable of the cable system is permanently attached to the compartment while the other end is wound about, for example, a geared rod attached between spindles and stored within the compartment. This free end of the cable system can be attached to a fire hose crank of conventional design once the compartment reaches the ground for the first time. The compartment can then be manually controlled.

Finally, although not shown in particular, brace cables may be provided and attached to the top and bottom of the building to prevent wind buffeting.

While the overall design details of the Terra Firma including size, materials and disposition are dependent upon the geometry of the building, it is contemplated that the suspension cable 36 would be formed from a material having a strength comparable to that of steel and having thermodynamic properties comparable to those of Haynes Stellite 21/31. If a single material does not provide the required strength and thermoproperties, then a composite material may be desirable. Further, while the number, size and location of the wheels schematically shown in FIG. 1 can be varied in accordance with the size of the Terra Firma compartment and the building on which it is used, the wheels and tires should be large enough to ensure a smooth and easy ride over relatively small wall ledges or between balconies. Where wall ledges are present, the wheels should be between two and four times the maximum extension of the wall ledge. If no wall ledges are present in the building, then a minimum tire diameter of two feet is envisioned to be desirable. The tire material itself is preferably similar to radial tires provided that the material forming the same is fire-retardant.

As noted above, the size of the Terra Firma compartments depends upon the size and purpose of the building, that is, whether the building is primarily residential or office space, and the geometry of the building including the number of accesses to the system. Thus, the length of the Terra Firma compartment can vary from covering the entire width of the building side wall to covering a predetermined exit passage or predetermined spacing between balconies, for example. The compartment provided in accordance with the present invention is ideally formed from a fire-retardant material. In that regard, as mentioned above, a multi-layer construction can be employed including an outer layer which is fire-resistant, a middle layer including spacers and heat insulation and an inner layer of more conventional structural materials for comfort of the riders.

While the invention has been described in connection with what is presently considered to be the most practical and preferred embodiment, it is to be understood that the invention is not limited to the disclosed embodiment, but, on the contrary, is intended to cover various modifications and equivalent arrangements included within the spirit and scope of the appended claims.

What is claimed is:

1. A fire/rescue system comprising:

at least one compartment sized and shaped so as to allow at least one individual to comfortably occupy the same;

means for mounting said compartment to a high-rise building so that said compartment can be disposed adjacent an exterior side wall of the high-rise building, said means for mounting including means for allowing said compartment to gradually descend and ascend along the side wall of the high-rise building, said means for mounting further including means for mounting each said compartment on an upper surface of the high-rise building and means for urging each said compartment horizontally relative to the upper surface to a peripheral edge of the upper surface, and means for suspending said compartment adjacent said exterior side wall so that said compartment can descend vertically downwardly along the side wall of the high-rise building, said means for urging comprising a push rod element mounted to said upper surface of said high-rise building for selectively urging said compartment horizontally on said upper surface, and control means for controlling vertical movement of said compartment along said side wall of the high-rise building so that said vertical movement is interrupted at predetermined locations along the side wall of the building for a predetermined period of time to allow passengers to enter and exit said compartment.

2. A system as in claim 1, wherein said means for mounting includes a cable coupled to said compartment and to a spindle mounted to the upper surface of the building, the rotation of said spindle allowing said cable and said compartment attached thereto to descend, and said means control includes means for controlling rotation of said spindle.

3. A system as in claim 1, wherein each said compartment includes a top wall, a bottom wall, side walls and a rear wall, access to said compartment being provided at least through a front opening in said compartment.

4. A system as in claim 3, wherein said top wall is hingedly mounted to one of said side walls, rear wall and a front wall of said compartment so that the interior of said compartment can be selectively accessed through said top wall.

5. A system as in claim 1, wherein each said compartment further comprises a plurality of wheels whereby said compartment rolls down said side wall of said high rise building.

6. A system as in claim 5, wherein said wheels have inflatable tires mounted thereto which are selectively inflatable and deflatable, said control means inflating said tires prior to vertical movement of said compartment.

7. A system as in claim 6, wherein each said wheel has a diameter of at least two feet.

8. A system as in claim 3, wherein at least a portion of at least one of sad top wall, bottom wall, side walls and rear wall is transparent.

9. A method of rescuing occupants of a high rise building comprising:

providing at least one compartment sized and shaped so as to allow at least one individual to comfortably occupy the same;

mounting said compartment to a high rise building so that said compartment can be selectively disposed adjacent an exterior side wall of said high rise building and moved vertically with respect thereto, said step of mounting further comprising the steps of mounting each said compartment on an upper surface of the high-rise building, and deploying each said compartment by urging each said compartment horizontally relative to said upper surface to a peripheral edge of said upper surface, allowing said compartment to pivot off of said upper surface into engagement with a side wall of said high-rise building, and suspending said compartment adjacent said side wall and then lowering said compartment along said side wall; and controllably moving said compartment vertically along said side wall of the high rise building so that said vertical movement is interrupted at predetermined locations along the side wall of the building for a predetermined period of time to allow passengers to enter and exit said compartment.

10. A method as in claim 9, wherein each said compartment has a plurality of wheels with inflatable tires mounted thereto and further comprising the step of inflating said tires prior to said step of urging.

* * * * *